US009775227B2

(12) United States Patent
Ban et al.

(10) Patent No.: US 9,775,227 B2
(45) Date of Patent: Sep. 26, 2017

(54) NON-THERMAL EQUILIBRIUM PLASMA IGNITION PLUG AND NON-THERMAL EQUILIBRIUM PLASMA IGNITION DEVICE

(71) Applicant: NGK SPARK PLUG CO., LTD., Nagoya-shi, Aichi (JP)

(72) Inventors: Kenji Ban, Gifu (JP); Hiroyuki Kameda, Nagakute (JP); Kohei Usami, Nagoya (JP)

(73) Assignee: NGK SPARK PLUG CO., LTD., Aichi (JP)

( * ) Notice: Subject to any disclaimer, the term of this patent is extended or adjusted under 35 U.S.C. 154(b) by 168 days.

(21) Appl. No.: 14/948,910

(22) Filed: Nov. 23, 2015

(65) Prior Publication Data

US 2016/0157332 A1 Jun. 2, 2016

(30) Foreign Application Priority Data

Dec. 1, 2014 (JP) ..... 2014-242860
Sep. 1, 2015 (JP) ..... 2015-171692

(51) Int. Cl.

| | |
|---|---|
| ***H01T 13/00*** | (2006.01) |
| ***H05H 1/52*** | (2006.01) |
| ***H01T 13/20*** | (2006.01) |
| ***H01T 15/00*** | (2006.01) |
| ***H01T 13/50*** | (2006.01) |
| *H01T 13/52* | (2006.01) |

(52) U.S. Cl.

CPC ..... *H05H 1/52* (2013.01); *H01T 13/20* (2013.01); *H01T 13/50* (2013.01); *H01T 15/00* (2013.01); *H01T 13/52* (2013.01)

(58) Field of Classification Search

CPC ..... H01T 15/00; H01T 13/20; H05H 1/52
USPC ..... 123/143 B
See application file for complete search history.

(56) References Cited

U.S. PATENT DOCUMENTS 5,950,585 A * 9/1999 Sarcarto ..... H01T 13/40 123/169 R
2009/0031988 A1* 2/2009 Shiraishi ..... F01L 13/0026 123/406.19

(Continued)

FOREIGN PATENT DOCUMENTS

JP 2009-036125 A 2/2009 ..... F02B 19/12
JP 2010-037949 A 2/2010 ..... F02B 11/00

(Continued)

OTHER PUBLICATIONS

Office Action received in corresponding Japanese Patent Application No. 2015-171692, dated Sep. 27, 2016 (English translation provided).

*Primary Examiner* — Thomas Moulis
(74) *Attorney, Agent, or Firm* — Kusner & Jaffe

(57) ABSTRACT

A non-thermal equilibrium plasma ignition plug including a tubular metallic shell having an axial hole extending along an axial line, an insulator disposed in such a manner as to form a gap in cooperation with a wall surface of the axial hole at a forward end portion of the metallic shell, and a center electrode held at the center of the insulator, and generates nonequilibrium plasma in response to voltage applied thereto from a power supply. The insulator has a plurality of depressions or protrusions formed on a surface thereof which faces a discharge space therearound.

6 Claims, 8 Drawing Sheets

(56) References Cited

U.S. PATENT DOCUMENTS

| | | | | |
|---|---|---|---|---|
| 2010/0282197 | A1* | 11/2010 | Permuy | H01T 19/04 123/143 B |
| 2012/0279468 | A1* | 11/2012 | Burrows | H01T 13/50 123/143 B |
| 2014/0026848 | A1 | 1/2014 | Abe et al. | 123/297 |
| 2014/0144402 | A1 | 5/2014 | Okabe et al. | 123/169 EL |
| 2014/0174416 | A1 | 6/2014 | Okabe et al. | 123/608 |

FOREIGN PATENT DOCUMENTS

| | | | | |
|---|---|---|---|---|
| JP | 2014-026754 | A | 2/2014 | H01T 13/20 |
| JP | 2014-107198 | A | 6/2014 | H01T 13/20 |
| JP | 2014-123435 | A | 7/2014 | H01T 13/20 |

* cited by examiner

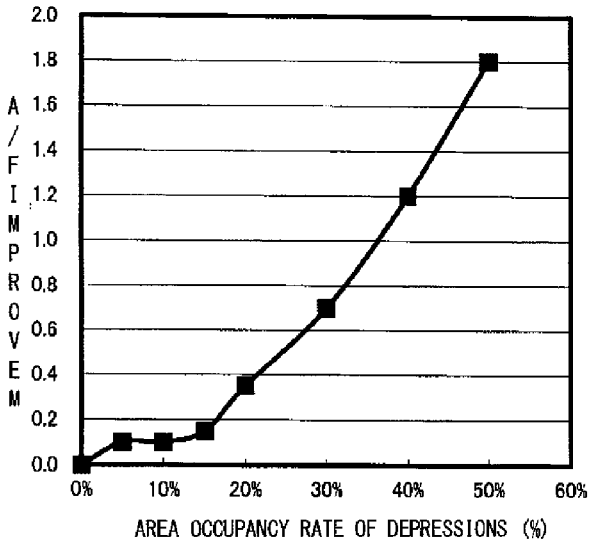

FIG. 6A

| Sample No. | Imaginary surface area of insulator ($mm^2$) | Surface area occupied by depressions ($mm^2$) | Area occupancy rate of depressions (%) | A/F improvement value | Remarks |
|---|---|---|---|---|---|
| S01 | 192 | 0 | 0 | 0.00 | Depressions not provided |
| S02 | 192 | 10 | 5 | 0.10 | Hemispheric depressions, ϕ 0.6, 6 × 6 array |
| S03 | 192 | 20 | 10 | 0.10 | Hemispheric depressions, ϕ 0.6, 8 × 9 array |
| S04 | 192 | 28 | 15 | 0.15 | Hemispheric depressions, ϕ 0.6, 10 × 10 array |
| S05 | 192 | 37 | 20 | 0.35 | Hemispheric depressions, ϕ 0.6, 11 × 12 array |
| S06 | 192 | 59 | 30 | 0.70 | Hemispheric depressions, ϕ 0.6, 14 × 15 array |
| S07 | 192 | 77 | 40 | 1.20 | Hemispheric depressions, ϕ 0.6, 16 × 17 array |
| S08 | 192 | 97 | 50 | 1.80 | Hemispheric depressions, ϕ 0.6, 18 × 19 array |

FIG. 6B

| Sample group | SG1 | SG2 | SG3 (S01-S08) | SG4 | SG5 | SG6 |
|---|---|---|---|---|---|---|
| 2R | 0.6 | 0.6 | 0.6 | 0.6 | 0.6 | 0.6 |
| D | 0.7 | 0.5 | 0.3 | 0.2 | 0.15 | 0.1 |
| R/D | 0.4 | 0.6 | 1.0 | 1.5 | 2.0 | 3.0 |

NON-THERMAL EQUILIBRIUM PLASMA IGNITION PLUG AND NON-THERMAL EQUILIBRIUM PLASMA IGNITION DEVICE

RELATED APPLICATIONS

This application claims the benefit of Japanese Patent Application No. 2014-242860, filed Dec. 1, 2014, and Japanese Patent Application No. 2015-171692, filed Sep. 1, 2015, the contents of which are included herewith by reference.

FIELD OF THE INVENTION

The present invention relates to a non-thermal equilibrium plasma ignition plug for generating non-thermal equilibrium plasma in a discharge space around an insulator and to a non-thermal equilibrium plasma ignition device.

BACKGROUND OF THE INVENTION

In recent years, in view of global resource conservation, improvement in fuel efficiency has been promoted for internal combustion engines. Particularly, since ignition techniques highly contribute to improvement in fuel efficiency of an internal combustion engine, various ignition techniques have been studied. A spark plug, which is a typical ignition device, is used in combination with an ignition coil for generating arc discharge in a spark discharge gap, thereby generating thermal equilibrium plasma and igniting fuel. Recently, an ignition device employing a different ignition phenomenon from a spark plug; specifically, a non-thermal equilibrium plasma ignition device, has been developed (See, for example, Japanese Patent Application Laid-Open (kokai) No. 2010-037949; Japanese Patent Application Laid-Open (kokai) No. 2014-026754; Japanese Patent Application Laid-Open (kokai) No. 2014-107198; Japanese Patent Application Laid-Open (kokai) No. 2014-123435). The non-thermal equilibrium plasma ignition device generates non-thermal equilibrium plasma by barrier discharge. Generally, barrier discharge is a discharge phenomenon in which discharge is generated by applying an AC voltage between two electrodes which are disposed with a certain gap therebetween and one or both of which are covered with an insulator. Since, different from thermal equilibrium plasma, non-thermal equilibrium plasma can be discharged in a wide space, non-thermal equilibrium plasma can efficiently generate radicals which contribute to combustion, and is thus effective for improving combustion performance.

However, the conventional non-thermal equilibrium plasma ignition plugs and the conventional non-thermal equilibrium plasma ignition devices have failed to generate a sufficient amount of plasma, resulting in a failure to sufficiently improve ignition performance. Thus, a technique for increasing the amount of generation of plasma has been desired.

SUMMARY OF THE INVENTION

The present invention has been conceived to solve the above problem and can be embodied in the following embodiments.

(1) In accordance with a first aspect of the present invention, there is provided a non-thermal equilibrium plasma ignition plug for generating non-thermal equilibrium plasma in a discharge space around an insulator. The non-thermal equilibrium plasma ignition plug comprises a tubular metallic shell having an axial hole extending along an axial line. An insulator is disposed in such a manner as to form a gap in cooperation with a wall surface of the axial hole at a forward end portion of the metallic shell, and is held to the metallic shell. A center electrode is held at the center of the insulator. The non-thermal equilibrium plasma ignition plug generates nonequilibrium plasma in response to voltage applied thereto from a power supply. The insulator has a plurality of depressions or protrusions formed on a surface thereof which faces a discharge space therearound.

According to this non-thermal equilibrium plasma ignition plug, since a plurality of depressions or protrusions are formed on that surface of the insulator which faces the discharge space, the substantial discharge area of the insulator increases; thus, the amount of radicals generated by non-thermal equilibrium plasma increases, whereby ignition performance can be improved.

(2) In accordance with a second aspect of the present invention, there is provided a non-thermal equilibrium plasma ignition plug as described above, wherein a surface area occupied by the plurality of depressions or protrusions may have an occupancy rate of 20% or more, with that surface area of the insulator which faces the discharge space being taken as 100%.

According to this configuration, by means of the surface area occupied by the plurality of depressions or protrusions having an occupancy rate of 20% or more, ignition performance can be significantly improved.

(3) In accordance with a third aspect of the present invention, there is provided a non-thermal equilibrium plasma ignition plug as described above, wherein a surface area occupied by the plurality of depressions or protrusions may have an occupancy rate of 50% or less, with that surface area of the insulator which faces the discharge space being taken as 100%.

According to this configuration, by means of the surface area occupied by the plurality of depressions or protrusions having an occupancy rate of 50% or less, there can be prevented deterioration in ignition performance which could otherwise result from the phenomenon in which a portion of concentration of electric field arises; accordingly, the substantial discharge area rather reduces.

(4) In accordance with a fourth aspect of the present invention, there is provided a non-thermal equilibrium plasma ignition plug as described above that may be configured such that the plurality of depressions or protrusions are a plurality of depressions, and the plurality of depressions satisfy a relational expression $0.6 \leq R/D \leq 2$, where R is the circle equivalent radius of an opening end of each of the plurality of depressions, and D is the depth of each depression, or such that the plurality of depressions or protrusions are a plurality of protrusions, and the plurality of protrusions satisfy a relational expression $0.6 \leq R/D \leq 2$, where R is the circle equivalent radius of a bottom end of each of the plurality of protrusions, and D is the height of each protrusion.

According to this configuration, employment of the above range of R/D can further improve ignition performance.

(5) In accordance with a fifth aspect of the present invention, there is provided a non-thermal equilibrium plasma ignition device. The non-thermal equilibrium plasma ignition device comprises the above-mentioned non-thermal equilibrium plasma ignition plug, and a high-voltage power supply which is an AC power supply for applying a predetermined high-frequency AC voltage to the non-thermal equilibrium plasma ignition plug, or a high-speed pulsed power supply for applying a high voltage to the non-thermal equilibrium plasma ignition plug a plurality of times in a pulsed manner.

According to this non-thermal equilibrium plasma ignition device, through utilization of an AC power supply or a high-voltage power supply, non-thermal equilibrium plasma can be generated for ignition.

(6) In accordance with a sixth aspect of the present invention, there is provided a non-thermal equilibrium plasma ignition device as described above, wherein the high-speed pulsed power supply may apply a high voltage for an application time of 1 ns to 250 ns per cycle.

According to this configuration, non-thermal equilibrium plasma can be generated within a discharge space without generation of arc discharge.

The present invention can be implemented in various forms. For example, the present invention can be implemented in the form of a non-thermal equilibrium plasma device, an ignition plug for a non-thermal equilibrium plasma device, or the like.

BRIEF DESCRIPTION OF THE DRAWINGS

FIG. 6A is a graph showing the effect of the surface area of depressions on ignition performance.

FIG. 6B is a table showing parameters of test samples.

DETAILED DESCRIPTION OF THE PREFERRED EMBODIMENTS

Figures 1A, 1B:
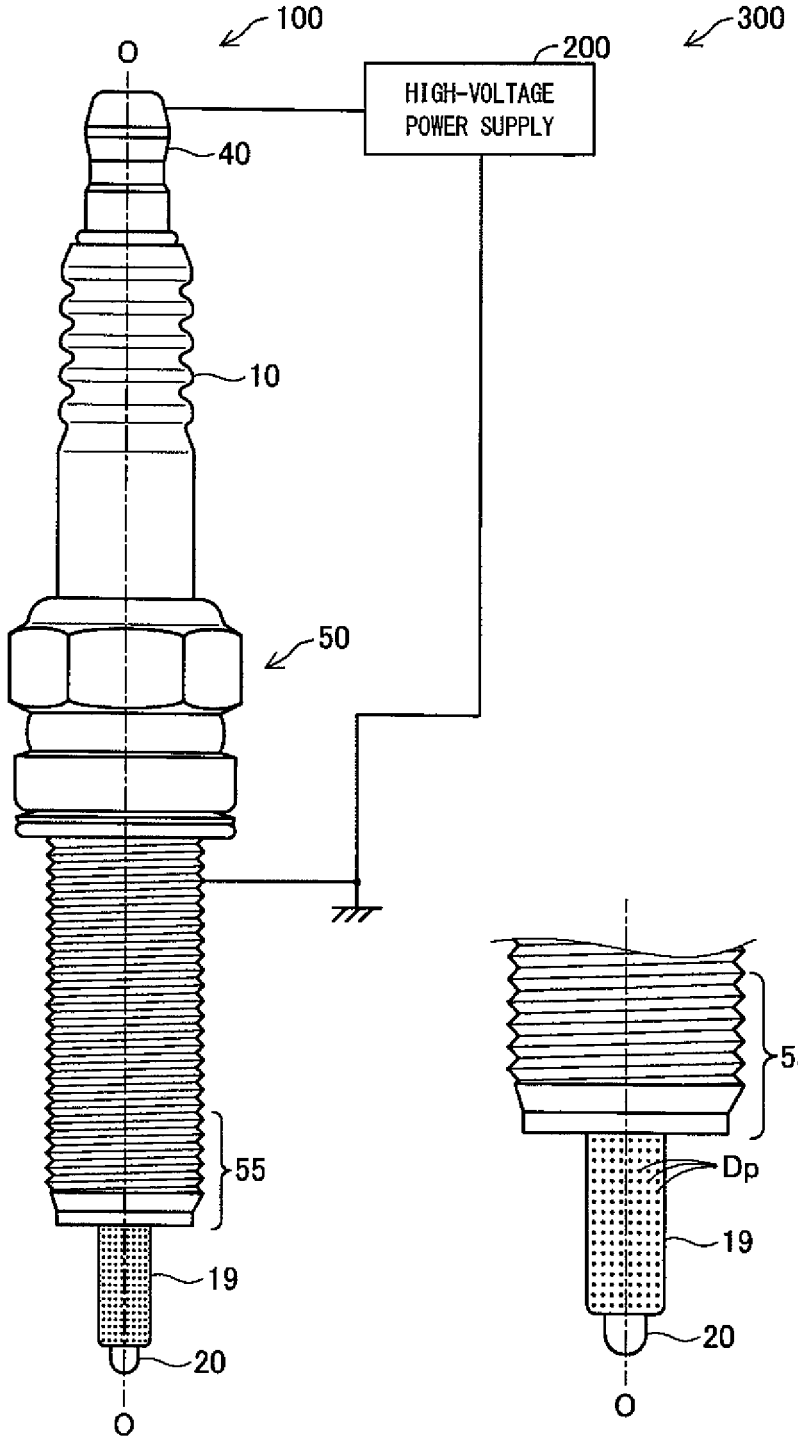
FIG. 1A is a front view showing a non-thermal equilibrium plasma ignition device according to an embodiment of the present invention.
FIG. 1B is an enlarged view showing a lower end portion of the non-thermal equilibrium plasma ignition device.

FIG. 1A is a front view showing a non-thermal equilibrium plasma ignition device 300 according to an embodiment of the present invention, and FIG. 1B is an enlarged view showing a lower end portion of the non-thermal equilibrium plasma ignition device 300. The non-thermal equilibrium plasma ignition device 300 includes a non-thermal equilibrium plasma ignition plug 100 and a high-voltage power supply 200. The non-thermal equilibrium plasma ignition plug 100 may be called merely the "ignition plug 100." In the following description, a direction along an axial line O of the ignition plug 100 is defined as the vertical direction; the lower side is defined as the forward side of the ignition plug 100; and the upper side is defined as the rear side. The ignition plug 100 includes an insulator 10, a center electrode 20, a metal terminal member 40, and a metallic shell 50. The metallic shell 50 is a tubular member which radially surrounds the insulator 10, and the insulator 10 is held to the metallic shell 50. A lower end portion of the metallic shell 50 functions as a ground electrode 55. The ground electrode 55 will be further described herein later. The center electrode 20 is a rod-like electrode extending along the axial line O and is inserted and held in an axial hole of the insulator 10. Preferably, the center electrode 20 is held at the center of the axial hole of the insulator 10.

A lower-end cylindrical portion 19 which forms a lower end portion of the insulator 10 protrudes downward from the lower end of the metallic shell 50. As shown on an enlarged scale in FIG. 1B, the insulator 10 has a plurality of depressions Dp formed on the surface of the lower-end cylindrical portion 19. The depressions Dp are provided for increasing the surface area of the lower-end cylindrical portion 19 to thereby increase the amount of generation of plasma. The structure of the lower-end cylindrical portion 19 will be further described herein later. The center electrode 20 protrudes downward from the lower-end cylindrical portion 19. The metal terminal member 40 is adapted to receive electricity and is electrically connected to the center electrode 20. When the ignition plug 100 is mounted to an engine head, the metallic shell 50 is grounded through the engine head.

The high-voltage power supply 200 has a function of generating non-thermal equilibrium plasma without generating arc discharge, by applying a high voltage between the metal terminal member 40 and the metallic shell 50. The high-voltage power supply 200 can be a high-speed pulsed power supply for applying a high voltage a plurality of times in a pulsed manner. For example, the high-speed pulsed power supply can generate non-thermal equilibrium plasma without generating arc discharge by cyclically applying a plurality of high-voltage pulses in such a manner as to apply a high voltage for an application time of 1 ns to 250 ns per cycle in order to perform ignition once. At this time, preferably, the period of oscillation is 20 ns to 0.1 ms (the oscillation frequency is 10 kHz to 50 MHz). Also, preferably, the high voltage has a voltage level of 15 kV to 50 kV. When such a pulsed high voltage is cyclically applied, barrier discharge is generated in the discharge space existing along the surface of the lower-end cylindrical portion 19 of the insulator 10, thereby generating non-thermal equilibrium plasma.

Figure 2A:
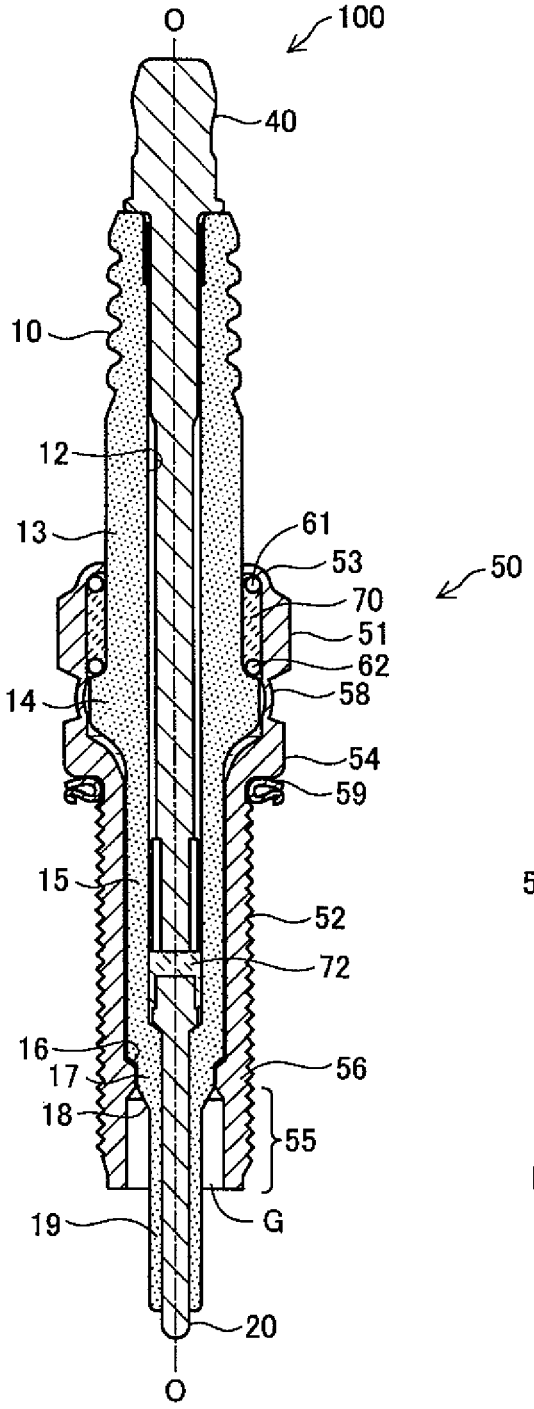
FIG. 2A is a sectional view showing a non-thermal equilibrium plasma ignition plug of the non-thermal equilibrium plasma ignition device of the embodiment.
Figure 2B:
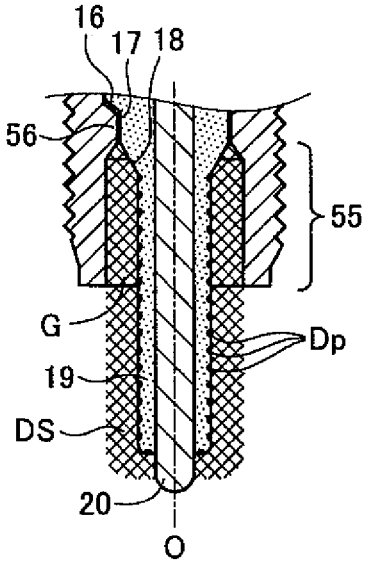
FIG. 2B is a sectional view showing a lower end portion of the non-thermal equilibrium plasma ignition plug.

FIG. 2A is a sectional view of the ignition plug 100, and FIG. 2B is an enlarged view showing a lower end portion of the ignition plug 100. The insulator 10 is formed of ceramic (e.g., alumina) and has an axial hole 12 extending along the axial line O. The insulator 10 has a large-diameter portion 14 formed at an approximately axially central position and having the greatest outside diameter. The insulator 10 has a rear trunk portion 13 located rearward of the large-diameter portion 14. The insulator 10 also has a forward trunk portion 15 located forward of the large-diameter portion 14, which is formed approximately at the center thereof, and being smaller in outside diameter than the rear trunk portion 13. The insulator 10 further has a first taper portion 16, an intermediate cylindrical portion 17, a second taper portion 18, and the lower-end cylindrical portion 19 which are located forward of the forward trunk portion 15. The two taper portions 16 and 18 reduce forward in outside diameter. A gap G is formed between the lower-end cylindrical portion 19 and the ground electrode 55. In other words, the gap G is formed between the wall surface of the axial hole of the ground electrode 55 and the surface of the lower-end cylindrical portion 19 of the insulator 10. Also, the second taper portion 18 faces the gap G. Barrier discharge is generated between the ground electrode 55, which is a lower end portion of the metallic shell 50, and the second taper portion 18 and the lower-end cylindrical portion 19 of the insulator 10. As shown on an enlarged scale in FIG. 2B, a discharge space DS (hatched region) in which barrier discharge is generated extends around the entire exposed portion (i.e., the second taper portion 18 and the lower-end cylindrical portion 19) of the insulator 10. In a state in which the ignition plug 100 is mounted to the engine head of an internal combustion engine, the discharge space DS communicates with a combustion chamber of the internal combustion engine.

The center electrode 20 is a rod-like member disposed in the axial hole 12 of the insulator 10 and extending forward from the rear side. In the present embodiment, the forward end of the center electrode 20 is exposed at the forward end of the insulator 10. In the axial hole 12 of the insulator 10, a seal member 72 is charged between the rear end of the center electrode 20 and the forward end of the metal terminal member 40. The center electrode 20 is electrically connected to the metal terminal member 40 through the seal member 72.

The metallic shell 50 is a tubular metallic member formed of a metal such as low-carbon steel and internally holds the insulator 10. The metallic shell 50 externally has a tool engagement portion 51 and a threaded portion 52. The tool engagement portion 51 allows an ignition plug wrench (not shown) to be fitted thereto. The threaded portion 52 has threads for engagement with a mounting threaded hole of the engine head of an internal combustion engine.

The metallic shell 50 has a flange-like collar portion 54 formed between the tool engagement portion 51 and the threaded portion 52 and protruding radially outward. An annular gasket 59 is fitted to the metallic shell 50 between the threaded portion 52 and the collar portion 54. The gasket 59 is formed by, for example, folding a plate-like member of metal. When the ignition plug 100 is mounted to the engine head, the gasket 59 is crushed and deformed. Through deformation of the gasket 59, a gap between the ignition plug 100 and the engine head is sealed, thereby restraining leakage of combustion gas.

The metallic shell 50 has a thin-walled crimped portion 53 located rearward of the tool engagement portion 51. The metallic shell 50 also has a thin-walled buckled portion 58 between the collar portion 54 and the tool engagement portion 51. Annular ring members 61 and 62 are disposed between an inner circumferential surface of the metallic shell 50 ranging from the tool engagement portion 51 to the crimped portion 53 and an outer circumferential surface of the rear trunk portion 13 of the insulator 10. Furthermore, a space between the ring members 61 and 62 is filled with talc 70 powder. In the course of manufacturing the ignition plug 100, when the crimped portion 53 is formed through radially inward bending for crimping, associated application of compressive force forms the buckled portion 58 through radially outward deformation (buckling); as a result, the metallic shell 50 and the insulator 10 are fixed together. In this crimping step, the talc 70 is compressed, thereby enhancing airtightness between the metallic shell 50 and the insulator 10.

The metallic shell 50 internally has a ledge portion 56 protruding radially inward. The ledge portion 56 is engaged with the first taper portion 16 and the intermediate cylindrical portion 17 of the insulator 10. Notably, an annular packing may be provided between the ledge portion 56 of the metallic shell 50 and the first taper portion 16 of the insulator 10 for enhancing airtightness.

A high-voltage cable (not shown) is connected to the metal terminal member 40 through a plug cap (not shown). As mentioned above, when a high-frequency pulsed high voltage is applied between the metal terminal member 40 and the engine head (i.e., the metallic shell 50), barrier discharge is generated between the ground electrode 55, which is a lower end portion of the metallic shell 50, and the second taper portion 18 and the lower-end cylindrical portion 19 of the insulator 10.

As shown in FIGS. 1B and 2B, the insulator 10 has a plurality of depressions Dp formed on the surface of the lower-end cylindrical portion 19. As mentioned above, the depressions Dp are provided for increasing the surface area of the lower-end cylindrical portion 19 to thereby increase the amount of generation of plasma.

Figure 3:
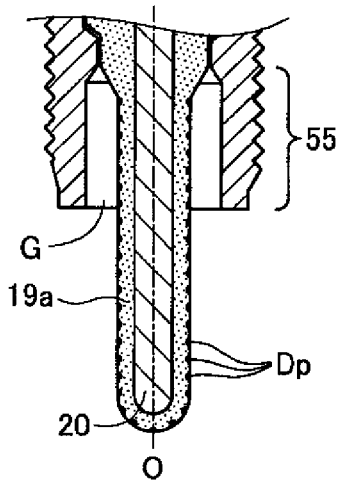
FIG. 3 is a sectional view of essential portions showing modifications of an insulator and a center electrode.

FIG. 3 is a sectional view of essential portions showing modifications of the insulator 10 and the center electrode 20. In this example, a lower-end cylindrical portion 19*a* of the insulator 10 covers the entire forward end portion of the center electrode 20. As is understood from this example, what is necessary for the center electrode 20 is to be held by the lower-end cylindrical portion 19 of the insulator 10, and either of the following modes can be employed: a form in which a forward end portion of the center electrode 20 protrudes downward from the lower-end cylindrical portion 19 of the insulator 10 (FIGS. 1A, 1B, 2A and 2B) and a form in which a forward end portion of the center electrode 20 is entirely covered with the lower-end cylindrical portion 19*a* of the insulator 10 (FIG. 3). In the case of the form in which the center electrode 20 is exposed, nonequilibrium plasma may fail to be stably maintained under certain conditions of power supply or ambient atmosphere. In view of this, preferably, the center electrode 20 is entirely covered with the insulator 10 (the center electrode 20 is not exposed).

According to the configuration shown in FIGS. 1A, 1B, 2A, 2B, and 3, the ignition plug 100 is configured such that the center electrode 20 and the lower-end cylindrical portion 19 of the insulator 10 protrude from the lower end of the ground electrode 55. However, the ignition plug 100 may be configured such that the center electrode 20 and the lower-end cylindrical portion 19 of the insulator 10 do not protrude from the lower end of the ground electrode 55. Preferably, the center electrode 20 and the lower-end cylindrical portion 19 of the insulator 10 protrude from the lower end of the ground electrode 55, since the discharge space DS (FIG. 2B) increases, whereby plasma and radicals can be generated in a larger amount.

Figure 4A:
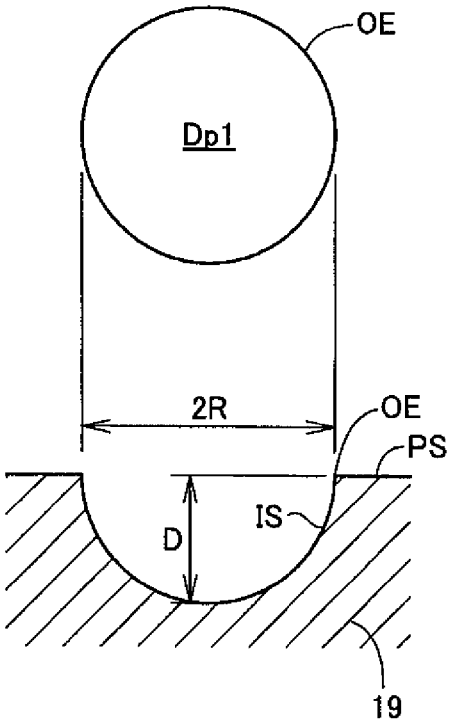
FIG. 4A is an explanatory view showing an example geometry of a depression.
Figure 4B:
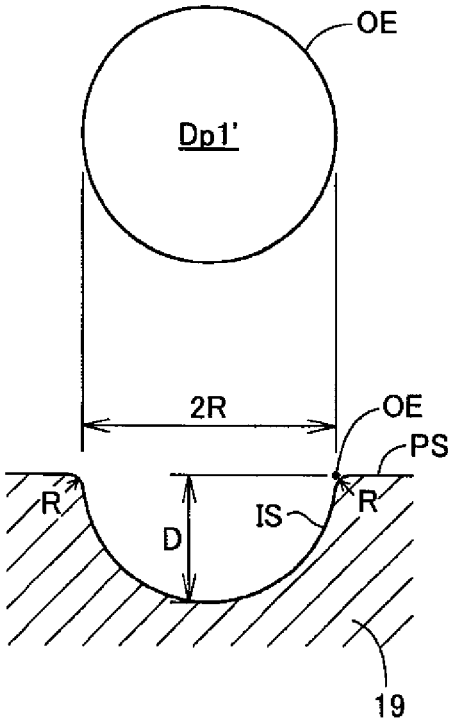
FIG. 4B is an explanatory view showing another example geometry of a depression.

FIGS. 4A and 4B explanatorily show example geometries of the depressions Dp. FIG. 4A shows a first depression Dp1 whose opening end OE has a circular shape and which is depressed approximately hemispherically (in an approximately arc section). The first depression Dp1 has radius R of the opening end OE and depth D. The opening end OE is an edge of intersection between a surface PS of a lower-end cylindrical portion 19 of the insulator 10 and an inner surface IS of the depression Dp1. The sectional shapes of the first depression Dp1 can be classified into the following three types according to the R/D value.

(1) R/D<1.0: The sectional shape of the depression Dp1 is shallower than that of a hemisphere.

(2) R/D=1.0: The sectional shape of the depression Dp1 is that of a hemisphere.

(3) 1.0<R/D: The sectional shape of the depression Dp1 is deeper than that of a hemisphere.

The relation between the R/D value and ignition performance will be described herein later.

A depression Dp1' shown in FIG. 4B is the first depression Dp1 shown in FIG. 4A whose opening end OE (edge) is cut. Edge-cutting can be radiusing or chamfering. In the case where opening is edge-cut, the opening end OE is defined as an edge of intersection between the extended surface PS of the lower-end cylindrical portion 19 of the insulator 10 and the extended inner surface IS of the depression Dp1. The same also applies to the other depressions to be described herein later. The depression Dp1' of FIG. 4B is substantially similar in geometry to the depression Dp1 of FIG. 4A and yields a similar effect. However, the depression Dp1' of FIG. 4B is preferred to the depression Dp1 of FIG. 4A for the following reason: since the edge (opening end OE) of the depression Dp1' is cut, the concentration of electric field can be restrained.

Figure 5A:
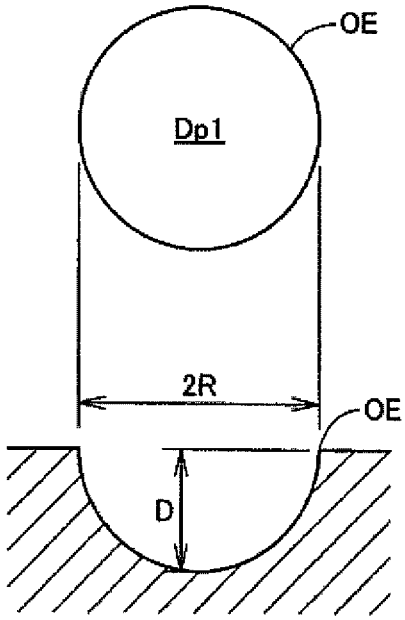
FIG. 5A is an explanatory view showing the example geometry of a depression of FIG. 4A.
Figure 5B:
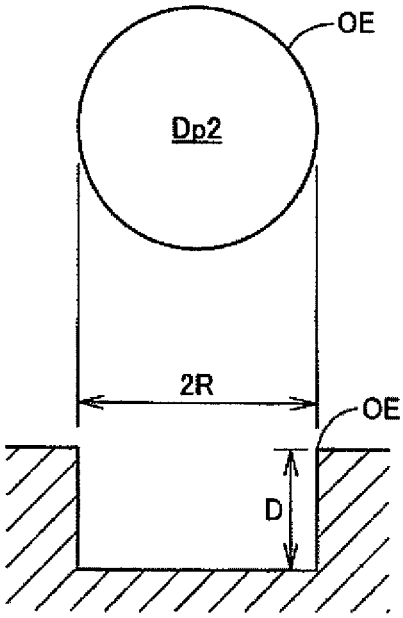
FIG. 5B is an explanatory view showing still another example geometry of a depression.
Figure 5C:
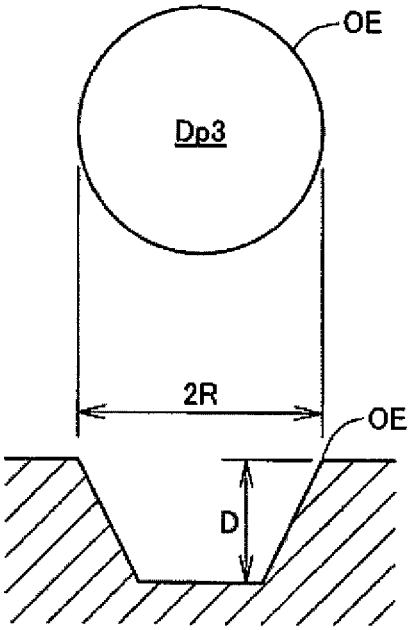
FIG. 5C is an explanatory view showing a further example geometry of a depression.
Figure 5D:
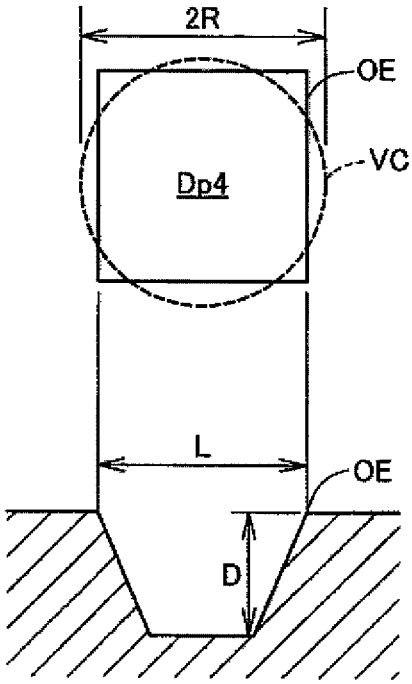
FIG. 5D is an explanatory view showing a further example geometry of a depression.

FIGS. 5A to 5D explanatorily show other example geometries of the depression Dp. FIG. 5A shows the same first depression Dp1 as that shown in FIG. 4A. FIG. 5B shows a second depression Dp2 whose opening end OE has a circular shape and which is depressed approximately in a cylindrical shape. FIG. 5C shows a third depression Dp3 whose opening end OE has a circular shape and which is depressed approximately in a truncated cone shape. FIG. 5D shows a fourth depression Dp4 whose opening end OE has a square shape and which is depressed approximately in a truncated pyramid shape. In the case where the opening end OE does not have a circular shape as in the case of the fourth depression Dp4, the depression Dp can be said to have circle equivalent radius R of the opening end OE and depth D. Any one of the depressions Dp1 to Dp4 may be employed. However, in view of easiness in machining the insulator 10, the first depression Dp1 is preferred. Notably, similar to the depression Dp1' shown in FIG. 4B, preferably, the edges (opening ends OE) of the depressions Dp2 to Dp4 shown in FIGS. 5B to 5D are radiused.

FIGS. 6A and 6B are a graph and a table showing the effect of the surface area of the depressions Dp on ignition performance. A lean limit air-fuel ratio (lean limit A/F) test was conducted on eight samples S01 to S08 shown in FIG. 6B. The samples S01 to S08 have the configuration of the ignition plug 100 shown in FIGS. 1 and 2. The column "imaginary surface area of insulator" shows the surface area of an insulator portion (the second taper portion 18 and the lower-end cylindrical portion 19) which faces the discharge space DS (FIG. 2(B)), and the surface area of the insulator portion is 192 $mm^2$ with all the samples. The term "imaginary surface area" means an area which does not take into account an increase in surface area as a result of the depressions Dp each having a depressed shape (i.e., the area of a smooth surface having no depressions Dp). As shown in the "remarks" column, in samples S02 to S08, the hemispheric depressions Dp were formed on the surface of the lower-end cylindrical portion 19. The opening ends of the depressions Dp had a diameter 2R of 0.6 mm. The column "surface area occupied by depressions" shows the total area of circles of opening ends of the depressions Dp. The column "area occupancy rate of depressions" shows the percentage of the surface area occupied by the depressions Dp to the imaginary surface area of the insulator. Meanwhile, at the insulator portion which faces the discharge space DS, the second taper portion 18 had an axial length of 1.4 mm, and the lower-end cylindrical portion 19 had an axial length of 14.5 mm. Also, at the lower-end cylindrical portion 19, a portion protruding downward from the ground electrode 55 had an axial length of 8.5 mm.

The column "A/F improvement value" located second from the right in FIG. 6B shows an increase in the lean limit air-fuel ratio of samples S02 to S08 with respect to the lean limit air-fuel ratio of sample S01 having no depressions Dp. The lean limit air-fuel ratio test was conducted as follows. First, the samples attached to an ignition device were mounted in a test chamber, and the test chamber was filled with an air-fuel mixture of air and propane. Then, a pulse voltage of 40 kV having a pulse width 10 ns was applied to generate barrier discharge in the discharge spaces DS, and a check was conducted to see whether or not the air-fuel mixture was ignited. The samples underwent this measurement 10 times each for different mixing ratios (air-fuel ratios). The "lean limit air-fuel ratio" was defined as the air-fuel ratio of an air-fuel mixture at which misfire occurred two times. The lean limit air-fuel ratio of sample S01 was 18.0. The A/F improvement value is a value obtained by subtracting the lean limit air-fuel ratio of sample S01 from the lean limit air-fuel ratios of samples S02 to S08. The greater the A/F improvement value, the more likely the ignition of a leaner air-fuel mixture, so that ignition performance is better.

FIG. 6A is a graph showing the relation between the area occupancy rate of the depressions Dp and the A/F improvement value for samples S01 to S08. As is understood from this graph, the samples S02 to S08 having the depressions Dp formed on the surfaces of the insulators 10 are greater in lean limit air-fuel ratio as compared with the sample S01 having no depressions Dp and are thus superior in ignition performance. Particularly, the employment of an area occupancy rate of the depressions Dp of 20% or more can significantly improve ignition performance. Presumably, the reason for improvement of lean limit air-fuel ratio through formation of the depressions Dp is that the inner surfaces of the depressions Dp increase the surface area of the insulator.

Notably, a physical limit exists with respect to the area occupancy rate of the depressions Dp. For example, in the case where the opening end OE (see FIG. 5A) of the depression Dp has a circular shape, on a development view of the surface of the insulator 10, the depressions Dp can be densely disposed by disposing the centers of the opening ends OE of the depressions Dp at the respective vertexes of regular triangles so as to render the circular opening ends OE tangent to one another. In this dense disposition, the area occupancy rate of the depressions Dp is 90.7%. Therefore, usually, the area occupancy rate of the depressions Dp is 90% or less. However, if the surface area occupancy rate of the depressions Dp is excessively large, portions of concentration of electric field may arise; accordingly, the substantial discharge area rather reduces, resulting in deterioration in ignition performance. In view of this, preferably, the area occupancy rate of the depressions Dp is 50% or less, since there can be prevented deterioration in ignition performance which could otherwise result from the phenomenon in which portions of concentration of electric field arise; accordingly, the substantial discharge area rather reduces.

Figures 7A, 7B:
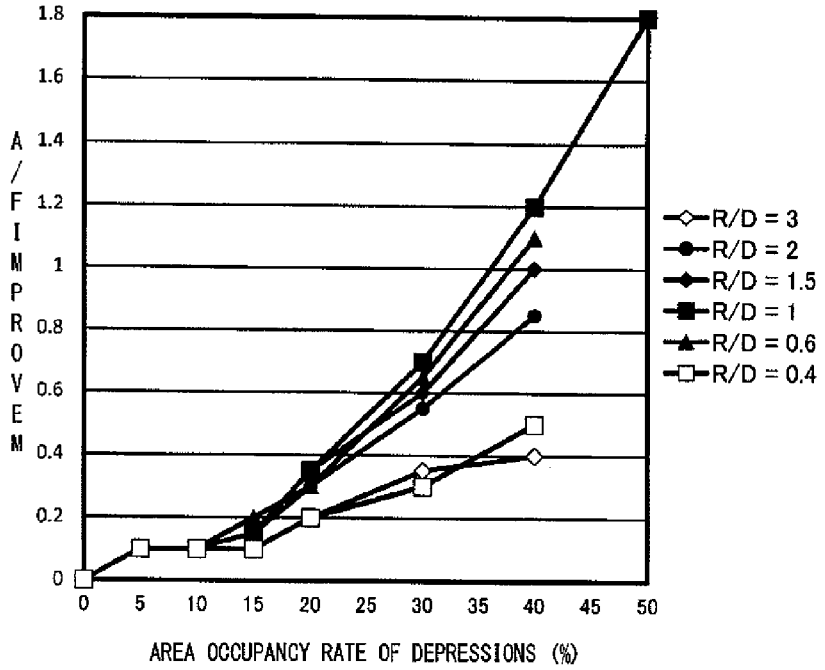
FIG. 7A is a graph showing ignition performance of sample groups which differ in the depth of depressions.
FIG. 7B is a table showing parameters of the sample groups.

FIGS. 7A and 7B are a graph and a table showing ignition performance of sample groups which differ in the depth of the depressions Dp. Six sample groups SG1 to SG6 were compared. The third sample group SG3 consists of eight samples S01 to S08 shown in FIG. 6. In the third sample group SG3, the depressions Dp have a diameter 2R of 0.6 mm and a depth D of 0.3 mm. The other sample groups have a diameter 2R of the depressions Dp of 0.6 mm and respective values of the depth D different from that of the third sample group SG3. The bottom row of FIG. 7B shows values of parameter R/D of the sample groups. The depressions Dp were formed as shown in FIG. 5A; specifically, the opening end OE had a circular shape, and the sectional shape cut along the depth direction had an arc shape.

FIG. 7A is a graph showing the relation between the area occupancy rate of the depressions Dp and the A/F improvement value among the sample groups SG1 to SG6. As is understood from this graph, in any of the sample groups SG1 to SG6, the samples having the depressions Dp formed on the surface of the insulator 10 are greater in lean limit air-fuel ratio as compared with the sample having no depressions Dp and are thus superior in ignition performance. Also, in any of the sample groups SG1 to SG6, the employment of an area occupancy rate of the depressions Dp of 20% or more can significantly improve ignition performance. Notably, in the sample groups SG1, SG2, SG4, SG5, and SG6 other than the third sample group SG3, the samples having an area occupancy rate of the depressions Dp of 50% were not tested. However, presumably, the sample groups SG1, SG2, SG4, SG5, and SG6, also, may show respective A/F improvement values extrapolated from the graph of FIG. 7A in a test conducted at an area occupancy rate of the depressions Dp of 50%.

The sample groups SG2 to SG5 having a parameter R/D value of 0.6 to 2.0 show large A/F improvement values and thus have good ignition performance. By contrast, the first sample group SG1 having a parameter R/D value of 0.4 and the sixth sample group SG6 having a parameter R/D value of 3.0 are smaller in A/F improvement value as compared with the other sample groups and are thus slightly inferior in ignition performance. The reason why the sixth sample group SG6 having a parameter R/D value of 3.0 is inferior in ignition performance is presumably that, because of an excessively small depth D of the depressions Dp, the surface area of the insulator did not increase substantially. Also, the reason why the first sample group SG1 having a parameter R/D value of 0.4 is inferior in ignition performance is presumably that, because of an excessively large depth D of the depressions Dp, discharges generated at the deep bottoms of the depressions Dp did not contribute much to ignition.

The test results shown in FIGS. 6A and 7A are of the samples having the depressions Dp1 shown in FIG. 5A. However, presumably, similar test results may be obtained in testing samples having the other depressions shown in FIGS. 5B to 5D and 4B. The reason for this is presumably that an improvement in lean limit air-fuel ratio shown in FIGS. 6A and 7A is attributed to an increase in substantial surface area resulting from the provision of the depressions and does not depend on the shape of the depressions.

Meanwhile, in the case of samples having a large depth D of the depressions Dp as in the first sample group SG1, concentration of electric field occurs at the opening ends OE of the depressions Dp, potentially causing deterioration in lean limit air-fuel ratio. In view of prevention of deterioration in lean limit air-fuel ratio caused by concentration of electric field, the provision of the depressions Dp is preferred to the provision of protrusions on the surface of the insulator as means for increasing the substantial surface area of the insulator. In view of existence of depressions and protrusions on the surface of the insulator, the forming of a large number of protrusions on the insulator surface resembles the forming of a large number of depressions on the insulator surface. However, in the present specification, the term "depressions" does not mean depressions formed among protrusions formed on a surface, but means depressions depressed from a smooth surface. The "smooth surface" preferably occupies the entire surface except the depressions Dp, particularly preferably 50% or more of a surface including the depressions Dp. In the latter case, the area occupancy rate of the depressions Dp is less than 50%.

As mentioned above, according to the non-thermal equilibrium plasma ignition device of the present embodiment, since a plurality of depressions Dp are formed on that surface of the insulator which faces the discharge space DG, the substantial discharge area of the insulator increases; thus, the amount of radicals generated by non-thermal equilibrium plasma increases, whereby ignition performance is improved.

Figure 8A:
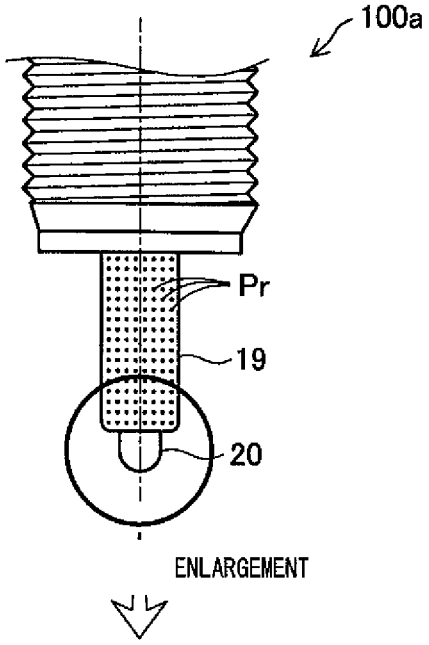
FIGS. 8A and 8B are views showing a lower end portion of a non-thermal equilibrium plasma ignition device according to another embodiment of the present invention.
Figure 8B:
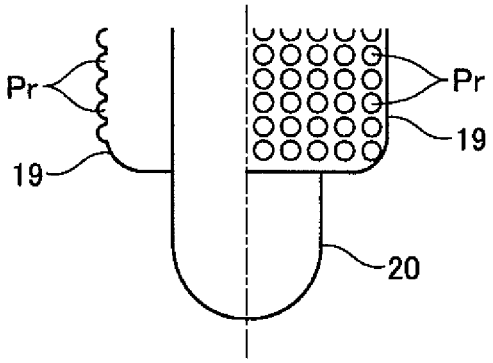
Figure 9A:
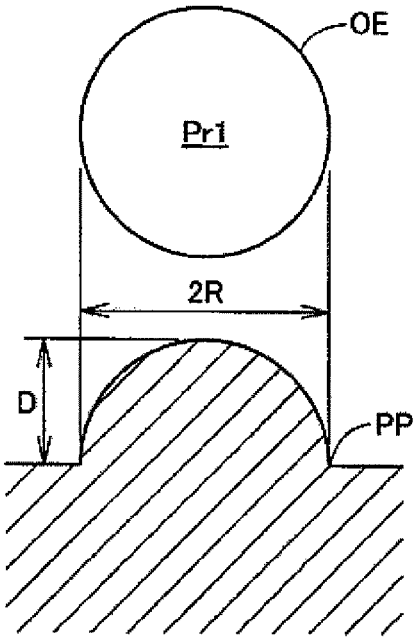
FIG. 9A is an explanatory view showing an example geometry of a protrusion.
Figure 9B:
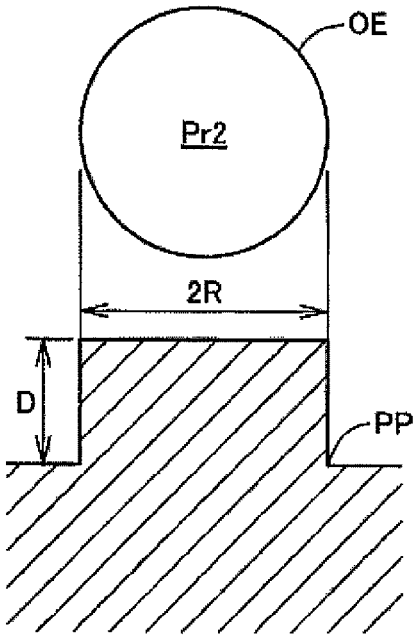
FIG. 9B is an explanatory view showing another example geometry of a protrusion.
Figure 9C:
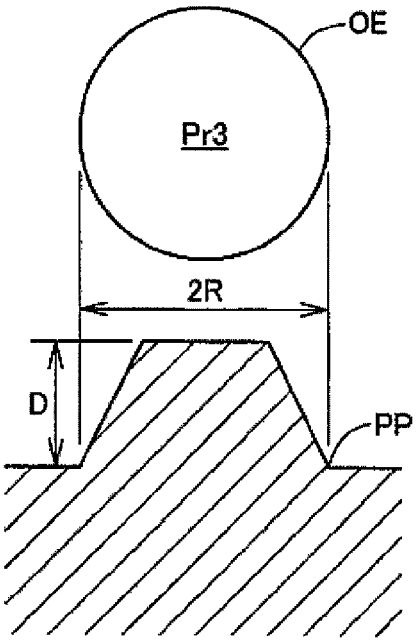
FIG. 9C is an explanatory view showing still another example geometry of a protrusion.
Figure 9D:
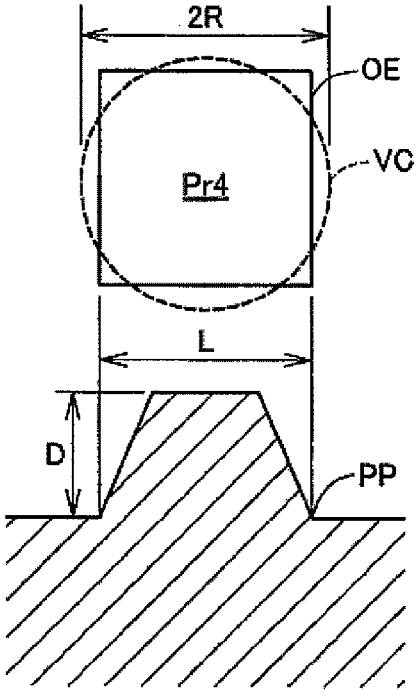
FIG. 9D is an explanatory view showing a further example geometry of a protrusion.

FIGS. 8A and 8B show a lower end portion of an ignition plug 100*a* of a non-thermal equilibrium plasma ignition device according to another embodiment of the present invention. FIG. 8A corresponds to FIG. 1B, and FIG. 8B is an enlarged view of FIG. 8A. The ignition plug 100*a* differs from the ignition plug 100 shown in FIGS. 1A and 1B in that the insulator 10 has a plurality of protrusions Pr, in place of the plurality of depressions Dp, formed on the surface of the lower-end cylindrical portion 19 of the insulator 10. Other constitutional features of the ignition plug 100*a* are similar to those of the ignition plug 100. The plurality of protrusions Pr are provided for increasing the surface area of the lower-end cylindrical portion 19 to thereby increase the amount of generation of plasma. The protrusions Pr can be formed by, for example, molding or thermal spraying.

FIGS. 9A to 9D are explanatory views showing example geometries of the protrusions Pr. The protrusions Pr1 to Pr4 have such a shape as to protrude to height D in a region surrounded by bottom end PP. The four types of protrusions Pr1 to Pr4 shown in FIGS. 9A to 9D correspond to the four types of depressions Dp1 to Dp4, respectively, shown in FIGS. 5A to 5D. That is, the bottom ends PP of the protrusions Pr1 to Pr4 shown in FIGS. 9A to 9D correspond to the opening ends OE of the depressions Dp1 to Dp4 shown in FIGS. 5A to 5D, and the height D of the protrusions Pr1 to Pr4 corresponds to the depth D of the depressions Dp1 to Dp4. Also, the radius (or circle equivalent radius) R of the bottom ends PP of the protrusions Pr1 to Pr4 corresponds to the radius (or circle equivalent radius) R of the opening ends OE of the depressions Dp1 to Dp4. Furthermore, length L of one side of the bottom end PP of the fourth protrusion Pr4 corresponds to the length L of one side of the opening end OE of the fourth depression Dp4. Notably, the protrusions Pr may also be edge-cut as described above with reference to FIG. 4B.

Presumably, the protrusions Pr may also yield test results similar to the depressions Dp shown in FIGS. 6A and 6B and FIGS. 7A and 7B. Also, the modifications and the preferred numerical ranges described above with respect to the depressions Dp are substantially applicable to the protrusions Pr.

As described above, providing a plurality of the protrusions Pr on the surface of the insulator 10 also yields effects similar to those yielded in the case of providing a plurality of the depressions Dp. Specifically, since providing the plurality of protrusions Pr increases the substantial discharge area of the insulator 10, the amount of radicals generated by non-thermal equilibrium plasma increases, whereby ignition performance can be improved.

Since the depressions Dp and the protrusions Pr yield substantially the same effects, the present specification uses the term "a plurality of depressions or protrusions" which encompasses both. For example, the expression "a plurality of depressions or protrusions formed on the surface of the insulator 10" encompasses both of the two expressions "a plurality of depressions formed on the surface of the insulator 10" and "a plurality of protrusions provided on the surface of the insulator 10." Notably, in the case where a plurality of the depressions Dp are formed on the surface of the insulator 10, the protrusions Pr may not be formed. To the contrary, in the case where a plurality of the protrusions Pr are formed on the surface of the insulator 10, the depressions Dp may not be formed. That is, preferably, only a plurality of the depressions Dp or only a plurality of the protrusions Pr are formed on the surface of the insulator 10.

MODIFICATIONS

The present invention is not limited to the above-described examples and embodiments, but may be embodied in various other forms without departing from the gist of the invention.

Modification 1

The present invention can be applied to non-thermal equilibrium plasma ignition devices having various configurations other than that shown in FIGS. 1A and 1B. Particularly, the metal terminal member, the insulator, and the metallic shell can be modified in various forms. For example, the above embodiments are described while mentioning the metallic shell having a function of the ground electrode. However, a separate ground electrode may be joined to the metallic shell. Also, the above-described embodiments use a high-speed pulsed power supply as the high-voltage power supply 200. However, the present invention is not limited thereto. The high-voltage power supply 200 may be an AC power supply which applies a predetermined high-frequency AC voltage.

DESCRIPTION OF REFERENCE NUMERALS

10: insulator
12: axial hole
13: rear trunk portion
14: large-diameter portion
15: forward trunk portion
16: first taper portion
17: intermediate cylindrical portion
18: second taper portion
19: lower-end cylindrical portion
20: center electrode
40: metal terminal member
50: metallic shell
51: tool engagement portion
52: threaded portion
53: crimped portion
54: collar portion
55: ground electrode
56: ledge portion
58: buckled portion
59: gasket
61: ring member
70: talc
72: seal member
100: ignition plug (non-thermal equilibrium plasma ignition plug)
200: high-voltage power supply
300: non-thermal equilibrium plasma ignition device Having described the invention, the following is claimed:

1. A non-thermal equilibrium plasma ignition plug comprising:
- a tubular metallic shell having an axial hole extending along an axial line;
- an insulator disposed in such a manner as to form a gap in cooperation with a wall surface of the axial hole at a forward end portion of the metallic shell, said insulator held to the metallic shell; and
- a center electrode held at the center of the insulator,
- the non-thermal equilibrium plasma ignition plug generating nonequilibrium plasma in response to voltage applied thereto from a power supply,
- wherein the insulator has a plurality of depressions or protrusions formed on a surface thereof which faces a discharge space therearound.

2. A non-thermal equilibrium plasma ignition plug according to claim 1, wherein a surface area occupied by the plurality of depressions or protrusions has an occupancy rate of 20% or more, with that surface area of the insulator which faces the discharge space being taken as 100%.

3. A non-thermal equilibrium plasma ignition plug according to claim 2, wherein the surface area occupied by the plurality of depressions or protrusions has an occupancy rate of 50% or less, with that surface area of the insulator which faces the discharge space being taken as 100%.

4. A non-thermal equilibrium plasma ignition plug according to claim 1, wherein
- the plurality of depressions or protrusions are a plurality of depressions, and the plurality of depressions satisfy a relational expression $0.6 \leq R/D \leq 2$, where R is the circle equivalent radius of an opening end of each of the plurality of depressions, and D is the depth of each depression, or
- the plurality of depressions or protrusions are a plurality of protrusions, and the plurality of protrusions satisfy a relational expression $0.6 \leq R/D \leq 2$, where R is the circle equivalent radius of a bottom end of each of the plurality of protrusions, and D is the height of each protrusion.

5. A non-thermal equilibrium plasma ignition device comprising:
- a non-thermal equilibrium plasma ignition plug including:
  - a tubular metallic shell having an axial hole extending along an axial line;
  - an insulator disposed in said metallic shell in such a manner as to form a gap in cooperation with a wall surface of the axial hole at a forward end portion of the metallic shell;
  - a center electrode held at the center of the insulator; and
  - a plurality of depressions or protrusions are formed on a surface and the insulator which faces a discharge space therearound; and a high-voltage power supply which is an AC power supply for applying a predetermined high-frequency AC voltage to the non-thermal equilibrium plasma ignition plug, or a high-speed pulsed power supply for applying a high voltage to the non-thermal equilibrium plasma ignition plug a plurality of times in a pulse manner.

6. A non-thermal equilibrium plasma ignition device according to claim 5, wherein the high-voltage power supply is the high-speed pulsed power supply, and the high-speed pulsed power supply applies a high voltage for an application time of 1 ns to 250 ns per cycle.

* * * * *